United States Patent [19]

Shanelec

[11] Patent Number: 4,961,715

[45] Date of Patent: Oct. 9, 1990

[54] SURFBOARD CONSTRUCTION

[76] Inventor: Dennis A. Shanelec, 1515 State St., Santa Barbara, Calif. 93101

[21] Appl. No.: 294,750

[22] Filed: Jan. 9, 1989

[51] Int. Cl.[5] ..... B29D 27/04

[52] U.S. Cl. ..... 441/74; 114/39.2; 264/DIG. 16

[58] Field of Search ..... 441/65, 67, 68, 74, 441/79, 129, 136; 114/39.2, 355, 357; 273/DIG. 12, 12; 264/DIG. 16, 41, 51

[56] References Cited

U.S. PATENT DOCUMENTS

| | | | |
|---|---|---|---|
| 3,830,900 | 8/1974 | Winstead | 264/DIG. 16 |
| 4,106,143 | 8/1978 | Lucas | 441/74 |
| 4,457,729 | 7/1984 | Peerlkamp | 441/74 |
| 4,545,772 | 10/1985 | Stockhausen | 441/74 |
| 4,587,916 | 5/1986 | Guerette | 114/39.2 |
| 4,693,199 | 9/1987 | Omachen | 114/39.2 |
| 4,698,191 | 10/1987 | Endo | 264/DIG. 16 |
| 4,720,509 | 1/1988 | Nakamura | 264/DIG. 16 |
| 4,745,870 | 5/1988 | Roth | 114/39.2 |
| 4,777,000 | 10/1988 | Kuwabara | 264/DIG. 16 |

*Primary Examiner*—Joseph F. Peters, Jr.
*Assistant Examiner*—Clifford T. Bartz

[57] ABSTRACT

Water sport equipment, such as surfboards, sailboards and the like formed of a molded foam composed of expanded polypropylene foam beads, having a density of approximately 3.75 PCF, melted together with steam pressure and improved methods for producing such equipment.

7 Claims, 1 Drawing Sheet

SURFBOARD CONSTRUCTION

BACKGROUND

1. Field of Invention

This invention relates to watersport equipment, such as surfboards, sailboards and the like and is particularly directed to improved methods and materials for contructing watersport equipment, such as surfboards, sailboards and the like.

2. Prior Art

The sport of surfboarding is of ancient origin in the Polynesian Islands and many methods and materials have been employed for producing surfboards. Originally, surfboards were carved from a single tree of Koa wood. As recently at the 1920s surfboards were hand-shaped from various hardwoods. Obviously, these solid surfboards were extremely heavy and difficult to maneuver. Furthermore, following a spill, these solid surfboards became potentially lethal weapons, as the board and rider were tumbled about in the surf. Later, solid hardwoods were laminated with Balsa wood to reduce the weight of the boards. However, even these surfboards weighed 80 to 100 pounds. In the 1930s, the surfboard industry was revolutionized by the introduction of hollow wooden, made of varnished plywood. In the 1940s, the introduction of fibreglass and resin, laminated by hand over a Balsa wood core, provided surfboards having increased strength and reducing the weight to about 40 pounds. Since the 1950s, the surfboard core has been formed primarily of polyurethane or polystyrene foam with wooden reinforcment, shaped with electric planers and sanders and covered with laminations of fibreglass and polyester or epoxy resin. Surfboards made in this way weigh 10 to 15 pounds and were relatively strong, light and maneuverable. Still more recently, attempts have been made to employ various molding processes for forming surfboards and the like. These methods have been somewhat satisfactory for production of sailboards, where weight is not as critical. However, for surfboards, the weight of molded boards has been excessive and the costs have been prohibitive. Moreover, even for sailboards, as this sport advances to include para-surfing and stunting, the demand for lighter and stronger boards makes the molding processes less desirable.

Furthermore, the popularity of watersport equipment, such as surfboards and sailboards, has been expanded to include a considerable variety of related devices, some of which are not even used on water. Thus, surf boards and sailboards usually have a fin depending from the underside thereof to facilitate steering and directional stability. However, a board of about 2.5 feet and having no fin, is called a "skimboard" and may be used for sliding over water or wet sand. Again, a board of about 3–4 feet having no fin, is called a "bodyboard" and is used to lie or kneel on while sliding down the face of a wave. a surfboard-like device, having a fin but designed to be towed by a boat is called a "waterski board", while a similar device, having no fin, is called a "skiboard" and may be used for sliding on snow or ice. All of the foregoing devices are included in the term "watersport equipment" and it will be apparent that each of these devices has individual requirements of length, strength and flexibility. With prior art materials and manufacturing methods, the cost and complexity of producing an entire line of such products has been prohibitive. Thus, none of the prior art materials or manufacturing methods have been entirely satisfactory.

BRIEF SUMMARY AND OBJECTS OF INVENTION

These disadvantages of prior art methods and materials for producing water sport equipment, such as surfboards, sailboards and the like have been overcome with the present invention and improved methods and materials are proposed which permit rapid and inexpensive mass production of surfboards, sailboards and the entire line of watersport equipment and produces watersport devices which are extremely light weight, yet are strong enough that no additional stiffening reinforcement is needed.

The advantages of the present invention are preferably attained by providing watersport equipment, such as surfboards, sailboards and the like, formed of a molded foam composed of expanded polypropylene foam beads, having a density of approximately 3.75 pounds per cubic foot (PCF, melted together with steam pressure. Polypropylene is the lightest of the major plastics and is the only plastic which will float on water in solid form. Also, at a density of 3.75 PCF, the polypropylene foam has a strength-to-weight ration 14 times greater than that of steel.

Accordingly, it is an object of the present invention to provide imporved watersport equipment, such as surfboards, sailboards and the like.

Another object of the present invention is to provide improved methods and materials for producing watersport equipment, such as surfboards, sailboards and the like.

A further object of the present invention is to provide materials for producing watersport equipment, such as surfboards, sailboards and the like which are extremely light weight, yet are strong enough so that no additional stiffening reinforcement is needed.

A further object of the present invention is to provide improved watersport equipment, such as surfboards, sailboards and the like which are extremely light weight and strong, yet are able to float and are safer than the devices of the prior art.

A specific object of the present invention is to provide water sport equipment, such as surfboards, sailboards and the like formed of a molded foam composed of expanded polypropylene foam beads, having a density of approximately 3.75 PCF, melted together with steam pressure and improved methods for producing such equipment.

These and other objects and features of the present invention will be apparent from the following detailed description.

DETAILED DESCRIPTION OF THE INVENTION

Figure 1:
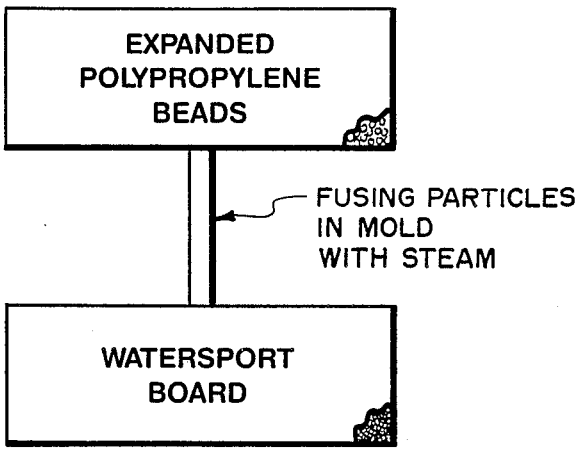
FIG. 1 shows a diagram detailing the process under which the water sport board of the present invention is constructed.

In accordance with the present invention, it has been found that excellent surfboards, sailboards and the like can be formed by pressurizing beads of expanded polypropylene with air, filling a suitable mold with the beads, and employing steam pressure to melt the beads into a foam product. Polypropylene has a specific gravity of 0.90 to 0.91. Consequently, it is the lightest of the major plastics and it the only plastic which will float on water in solid form. This, of course, is a distinct advantage for manufacturing equipment for water sports, such as surfing. Moreover, expanded polypropylene foam can be formed with densities ranging from 0.5 pounds per cubic foot (PCF) to 18 PCF. However, for manufacturing surfboard, sailboards and the like, it is preferred that the product density be in the range of 1.0 to 5.0 PCF. Densities below 1.0 PCF make the board too flexible, while densities above 5.0 PCF make the board too heavy. Moreover, at 3.75 PCF expanded polypropylene foam products have a strength:weight ratio which is 14 times greater than that of steel. Consequently, no additional stiffening reinforcement is needed to prevent bending of the boards. Furthermore, products formed of expanded polypropylene foam are found to have excellent barrier properties and low permeability to moisture which permits water sport products made of this material to need no protective coatings. In addition, expanded polypropylene foam products are found to have toughness, flexibility, chemical resistance and resistance to fatique which make this material ideally suited for water sport equipment. Finally, it has been found the expanded polypropylene foam products have outstanding shock absorbing properties. In fact, since 1985, expanded polypropylene foam has found increasing use in automobile bumper cores, reusable containers and cushion packaging. When used in producing water sport equipment, this means that the boards will be considerably safer for their users, should they fall and get struck by the board as they are tumbled together in the surf.

Obviously, numerous variations and modifications can be made without departing from the spirit of the present invention. Therefore, it should be clearly understood that the forms of the present invention described above are illustrative only and are not intended to limit the scope of the present invention.

What is claimed is:

1. Improved water sport equipment comprising:

a water sport board composed of expanded polypropylene (foam) beads fused together in a mold under steam pressure to form a water sport board having a density in the range of 1.0 to 5.0 pounds per cubic foot.

2. The equipment of claim 1 wherein: said water sport board is a skimboard.

3. The equipment of claim 1 wherein: said water sport board is a bodyboard.

4. The equipment of claim 1 wherein: said water sport board is a surfboard.

5. The equipment of claim 1 wherein: said water sport is a sailboard.

6. The equipment of claim 1 wherein: said water sport board is a waterski board.

7. The equipment of claim 1 wherein: said water sport board is a skiboard.

* * * * *